US006159061A

United States Patent [19]

Gorokawa

[11] Patent Number: 6,159,061

[45] Date of Patent: Dec. 12, 2000

[54] TILTING APPARATUS FOR MARINE PROPULSION UNIT

[75] Inventor: Akira Gorokawa, Saitama, Japan

[73] Assignee: Showa Corporation, Saitama, Japan

[21] Appl. No.: 09/374,887

[22] Filed: Aug. 13, 1999

[51] Int. Cl.[7] ..... B63H 5/125

[52] U.S. Cl. ..... 440/61; 440/53

[58] Field of Search ..... 440/53, 55, 56, 440/61

[56] References Cited

U.S. PATENT DOCUMENTS 5,368,509 11/1994 Tsujii ..... 440/56

FOREIGN PATENT DOCUMENTS 61-40638 1/1986 Japan .

63-53027 4/1988 Japan .

335675 7/1991 Japan .

2531471 1/1997 Japan .

*Primary Examiner*—Ed Swinehart

*Attorney, Agent, or Firm*—Orum & Roth

[57] ABSTRACT

A tilting apparatus for a marine propulsion unit is provided with an accumulator provided in a supply line of hydraulic oil positioned between a pump and a changing-over valve for accumulating and reserving the hydraulic oil discharged by the pump, an accumulate pressure sensor for detecting the accumulated pressure in the accumulator, and a control circuit for driving the pump to accumulate the hydraulic oil into the accumulator when the accumulated pressure in the accumulator detected by the accumulated pressure sensor is lower than a preset value.

8 Claims, 4 Drawing Sheets

TILTING APPARATUS FOR MARINE PROPULSION UNIT

BACKGROUND OF THE INVENTION

1. Field of the Invention

The present invention relates to a tilting apparatus for a marine propulsion unit.

2. Description of the Related Art

A conventional tilting apparatus for a marine propulsion unit is configured such that a marine propulsion unit engine can be tilted up by supplying hydraulic oil fed by a pump to a cylinder device via a changing-over valve to advance the cylinder device.

In the conventional art, the tilting-up speed of a marine propulsion unit is determined by the discharge level of a pump for supplying hydraulic oil to a cylinder device, namely the capacity of the pump, thereby limiting the speed of the tilting-up.

SUMMARY OF THE INVENTION

An object of the present invention is to increase the tilting-up speed for a marine propulsion unit independently of pump capacity.

The present invention is a tilting apparatus for a marine propulsion unit provided with a cylinder device interposed between a ship body and a marine propulsion unit, a tank for containing hydraulic oil, a pump for discharging the hydraulic oil in the tank, and a changing-over valve capable of changing and connecting a supply line for the hydraulic oil discharged by the pump to a chamber positioned opposite to a piston rod of the cylinder device, the apparatus comprising an accumulator provided in a portion of the supply line positioned between the pump and the changing-over valve, for accumulating the hydraulic oil discharged by the pump; an accumulated-pressure sensor for detecting a magnitude of accumulated-pressure in the accumulator; and a control circuit for accumulating the hydraulic oil in the accumulator by driving the pump when the magnitude of accumulated-pressure in the accumulator detected by the accumulated-pressure sensor becomes lower than a preset value.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENTS

Figure 1:
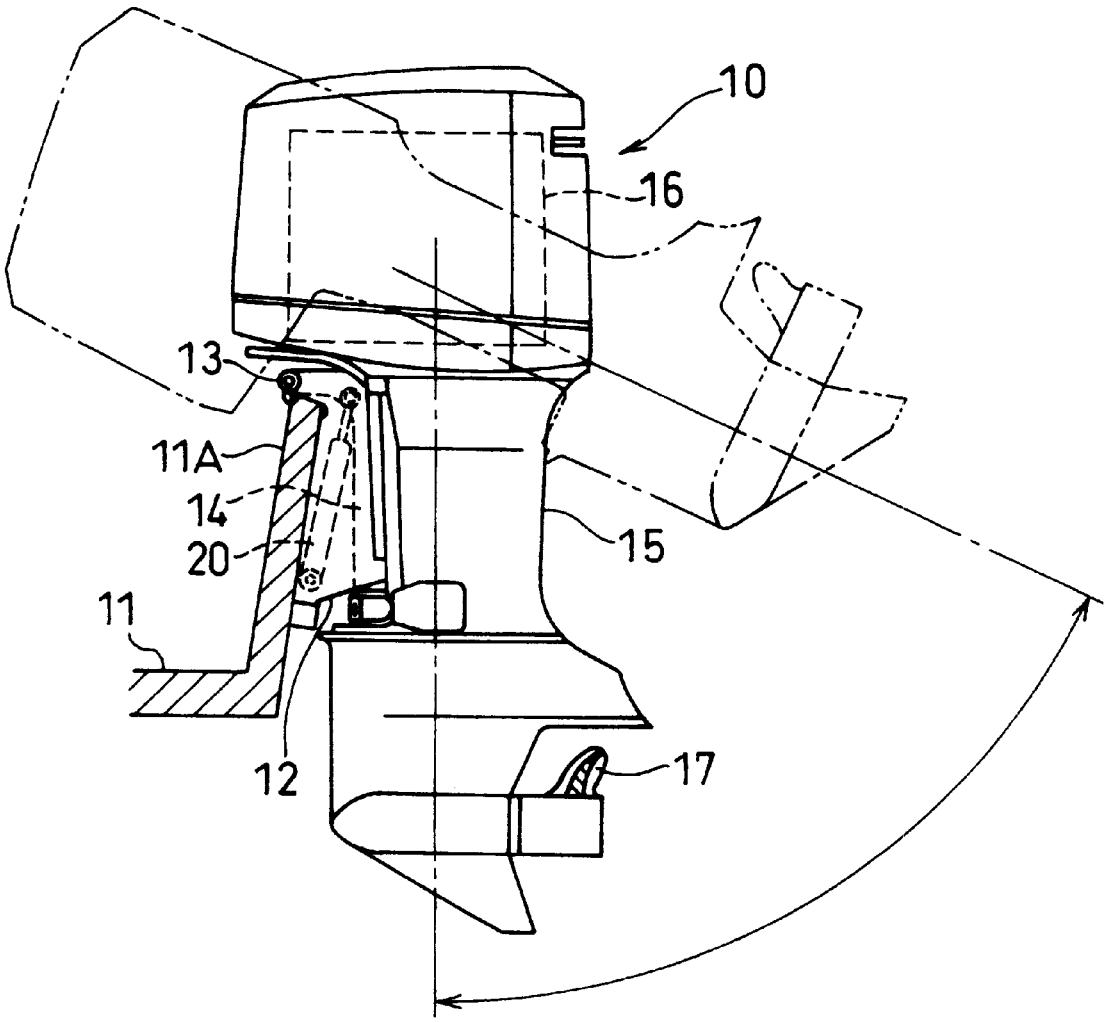
FIG. 1 is an illustrative view showing a marine propulsion unit.

In a marine propulsion unit 10 (which is an outboard engine, but it may also be an inboard engine), a clamp bracket 12 is fixed to a stem board 11A of a ship body 11 and a swivel bracket 14 is pivoted to the clamp bracket 12 via a tilting shaft 13 such that it can be tilted about an approximately horizontal axis. A propelling unit 15 is pivoted to the swivel bracket 14 rotatably about a steering shaft (not shown) via the steering shaft disposed approximately vertically. An engine unit 16 is mounted on an upper portion of the propelling unit 15, and a propeller 17 is provided at a lower portion of the propelling unit 15.

That is, in the marine propulsion unit 10, the propelling unit 15 is supported to the damp bracket 12 fixed to the ship body 11 via the tilting shaft 13 and the swivel bracket 14 such that it can be tilted, and a cylinder device 21 of a tilting apparatus 20 is interposed between the clamp bracket 12 and the swivel bracket 14. The cylinder device 21 advances to allow the propelling unit 15 to be tilted by controlling supply/discharge of hydraulic oil to/from the cylinder device 21 from a hydraulic oil supply/discharge device 22 via a changing-over valve 23.

(CYLINDER DEVICE 21)

Figure 2:
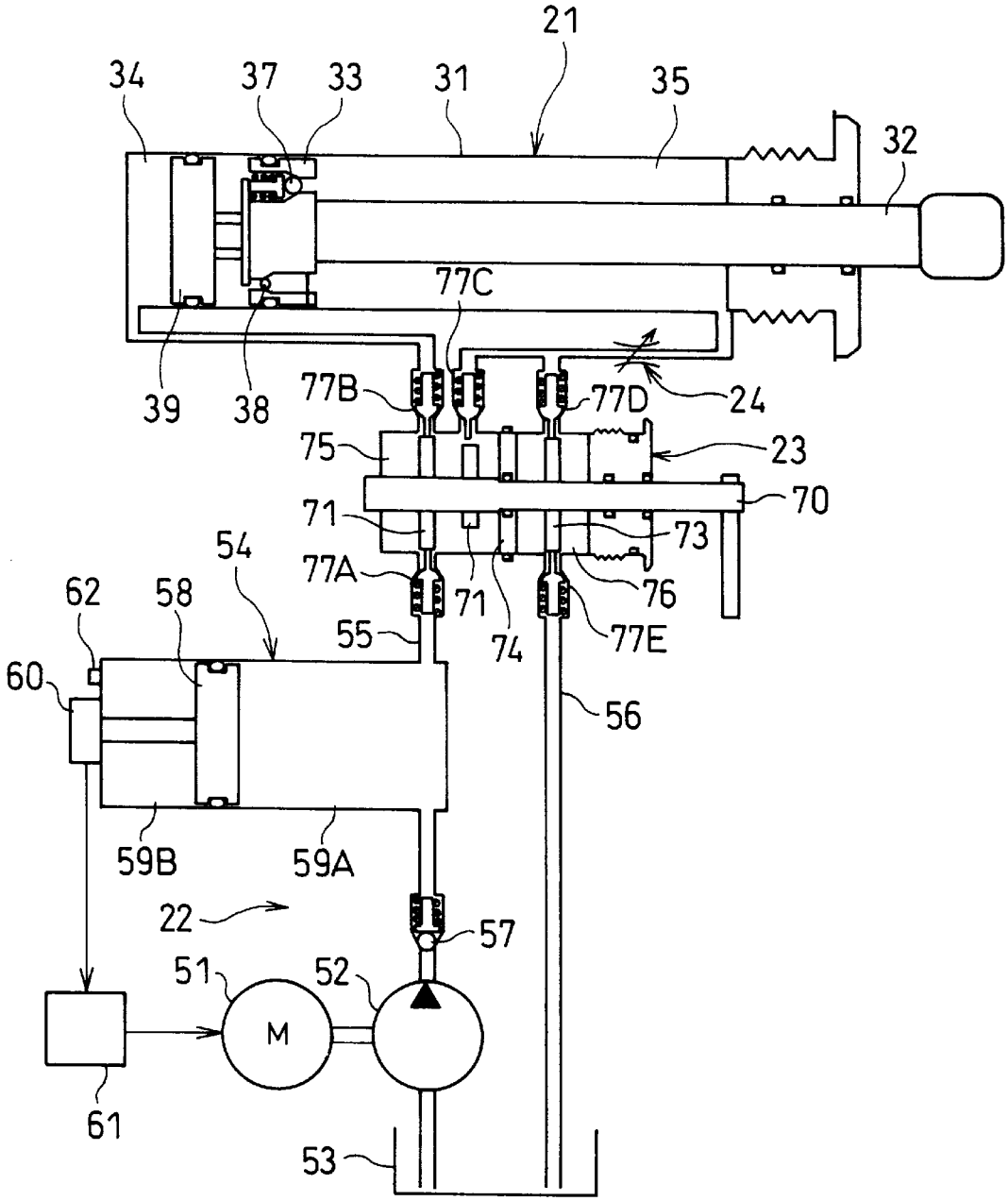
FIG. 2 is a hydraulic circuit showing an embodiment of a tilting apparatus.

As shown in FIGS. 1 and 2, the cylinder device 21 comprises a cylinder 31 connected to the clamp bracket 12 by a pin and a piston rod 32 connected to the swivel bracket 14 by a pin. A piston 33 fixed to the piston rod 32 is inserted into the cylinder 31 so that a cavity of the cylinder 31 positioned on a side opposed to the piston rod of the piston 33 is defined as a lower chamber 34, and a cavity of the cylinder 31 positioned on a side of the piston rod is defined as an upper chamber 35.

In the cylinder device 21, the piston 33 has an advancing side buffer valve 37 and a check valve 38. The advancing side buffer valve 37 is opened at a predetermined pressure for protecting a hydraulic circuit when an impact force acts in an advancing direction of the cylinder device 21, for example when driftwood collides on the propelling unit 15, and the hydraulic oil in the upper chamber 35 is fed to a side of a free piston 39 within the lower chamber 34, so that the piston rod 32 can be advanced. At this time, the free piston 39 remains at its original position and only the piston 33 moves. The check valve 38 is opened when the piston 33 is returned back to its original position (which is a position where the free piston remains) by the weight of the propelling unit 15 itself, so that the hydraulic oil positioned between the piston 33 and the free piston 39 is returned back to the upper chamber 35.

(HYDRAULIC OIL SUPPLYING/DISCHARGING DEVICE 22)

As shown in FIG. 2, the hydraulic oil supplying/discharging device 22 comprises an electric motor 51, a pump 52, a tank 53 and an accumulator 54, which allows hydraulic oil to be supplied to/discharged from the lower chamber 34 and the upper chamber 35 of the cylinder device 21 via a supply line 55 and a return line 56.

The hydraulic oil discharged by the pump 52 is accumulated, or received in a pressure-accumulated state, in the accumulator 54 via a check valve 57. The accumulator 54 is partitioned into an oil chamber 59A communicating with the supply line 55 and a high pressure gas chamber 59B by a free piston 58. The accumulator 54 is provided with an accumulated pressure sensor 60 for detecting a position of the free piston 58. The accumulated pressure sensor 60 can detect an amount or magnitude of accumulated pressure in the accumulator 54. A control circuit 61 is in communication with the detected result of the accumulated pressure sensor 60, and controls driving of the pump 52 such that the hydraulic oil is accumulated in the accumulator 54 until the accumulated pressure in the accumulator 54 becomes a preset value when the accumulated pressure in the accumulator 54 is lowered below the preset value. The accumulator 54 is provided with a gas pressure adjusting valve 62, so that the gas pressure in the high pressure gas chamber 59B can be adjusted.

(CHANGING-OVER VALVE 23)

The changing-over valve 23 can be changed over and set to either one of three modes, including an up-operation mode (A) where the accumulator 54 and the lower chamber 34 are connected to each other and the upper chamber 35 is connected to the tank 53, a down-operation mode (B) where the lower chamber 34 and the upper chamber 35 are connected to the tank 53, and a lock-operation mode (C) where the lower chamber 34 and the upper chamber 35 are respectively dosed.

Specifically, as shown in FIG. 2, a rotary type changing-over valve is employed as the changing-over valve 23, which is provided with a first cam 71, a second cam 72 and a third cam 73 mounted on an operation rod 70. The first cam 71 and the second cam 72 are disposed in an oil chamber 75 positioned on one side of a partition 74 while the third cam 73 is disposed in an oil chamber 76 on the other side thereof. Respective check valves of an accumulator communication port 77A and a lower chamber communication port 77B can be opened/closed by the first cam 71. A check valve of an upper chamber communication port 77C can be opened/closed by the second cam 72, and an upper chamber communication port 77D and a tank communication port 77E can be opened/closed by the third cam 73. Thereby, the rotary type changing-over valve 23 can perform the following changing-over operations (A) to (C).

(A) At a first rotated position of the operation rod 70, the respective check valves of the accumulator communication port 77A and the lower chamber communication port 77B are opened by the first cam 71 so that the accumulator communication port 77A and the lower chamber communication port 77B are caused to communicate with each other, and the respective valves of the upper chamber communication port 77D and the tank communication port 77E are opened by the third cam 73 so that the upper chamber communication port 77D and the tank communication port 77E are caused to communicate with each other. Thus, the above up-operation mode can be effectuated.

(B) At a second rotated position of the operation rod 70, the check valve of the lower chamber communication port 77B is opened by the first cam 71, and the check valve of the upper chamber communication port 77C is opened by the second cam 72, so that the lower chamber communication port 77B and the upper chamber communication port 77C are caused to communicate with each other. The respective check valves of the upper chamber communication port 77D and the tank communication port 77E are opened by the third cam 73 so that the upper chamber communication port 77D and the tank communication port 77E are caused to communicate with each other. Thus, the above down-operation mode can be effectuated.

(C) At a third rotated position of the operation rod 70, all of the ports 77A to 77E are closed by the first cam 71, the second cam 72 and the third cam 73.

(VARIABLE LOW RATE THROTTLE VALVE 24)

A hydraulic oil supplying/discharging device 22 can control advancing/retracting motion of the cylinder device 21, namely, a tilting-up speed and a tilting-down speed of the tilting device 20, by a variable flow rate throttle valve 24 interposed in a hydraulic oil return line 56 connected to the upper chamber 35 of the cylinder device 21.

Accordingly, the tilting device 20 operates as follows:

(1) Tilt Up

The changing-over valve 23 is changed over and set to the above up-operation mode. Thereby, the hydraulic oil accumulated and reserved in the accumulator 54 flows in the lower chamber 34 of the cylinder device 21 from the supply line 55 via the accumulator communication port 77A and the lower chamber communication port 77B. The hydraulic oil in the upper chamber 35 of the cylinder device 21 is returned back to the tank 53 from the return line 56 via the upper chamber communication port 77D and the tank communication port 77E, so that the cylinder device 21 is operated so as to advance. At this time, the hydraulic oil of an amount larger than the discharge amount of the pump 52 is forcibly fed to the lower chamber 34 of the cylinder device 21 due to the accumulated pressure in the accumulator 54, so that the tilt-up operation can be speeded up.

(2) Tilt Down

The changing-over valve 23 is changed over and set to the above down-operation mode. Thereby, the hydraulic oil in the lower chamber 34 of the cylinder device 21 is fed by the weight of the propelling unit 15 itself, and is transferred to the upper chamber 35 of the cylinder device 21 from the supply line 55 via the lower chamber communication port 77B, the upper chamber communication port 77C and the return line 56, so that the cylinder device 21 is operated to retract. At this time, excess hydraulic oil corresponding to a volume of the piston rod 32 entering in the cylinder 31 of the cylinder device 21 is returned back to the tank 53 from the return line 56 via the upper chamber communication port 77D and the tank communication port 77E.

In the above (1) and (2), the tilt-up speed and the tilt-down speed can be controlled according to setting of the variable flow rate throttle valve 24.

The changing-over valve 23 is not limited to the above rotary type changing-over valve but it may be anther type valve such as a spool type changing-over valve. Also, the changing-over valve 23 may be an electromagnetic type changing-over valve which can easily be controlled by remote operation. Furthermore, a needle type throttle valve, a rotary type throttle valve where the size of an aperture can be changed, or the like, can be employed as the variable flow rate throttle valve 24. Also, a pressure sensor for detecting the pressure in the oil chamber 59A or the like can be employed as the accumulated pressure sensor 60 of the accumulator 54.

Accordingly, the tilting device 20 operates as follows.

(1) During a tilt-up period of the marine propulsion unit 10, when the accumulator 54 is connected to the lower chamber 34 of the cylinder device 21 by the changing-over valve 23, the accumulated pressure hydraulic oil in the accumulator 54 is supplied to the lower chamber 34 of the cylinder device 21 to advance the cylinder device 21, so that the ship propelling engine 10 is tilted up. At this time, the hydraulic oil of an amount more than the discharge amount of the pump 52 can be supplied to the lower chamber 34 of the cylinder device 21 due to the setting of the accumulated pressure in the accumulator 54, so that the tilting-up operation can be speeded up.

(2) The tilt-up speed and the tilt-down speed of the marine propulsion unit 10 can be controlled by interposing the variable flow rate throttle valve 24 in the hydraulic oil return line 56 of the cylinder device 21.

Also, the following first to third examples can be employed as an arrangement of the cylinder device 21, the hydraulic oil supplying/discharging device 22 (the motor 51, the pump 52, the tank 53 and the accumulator 54) and the changing-over valve 23 constituting the tilting device 20.

EXAMPLE 1

Figure 3:
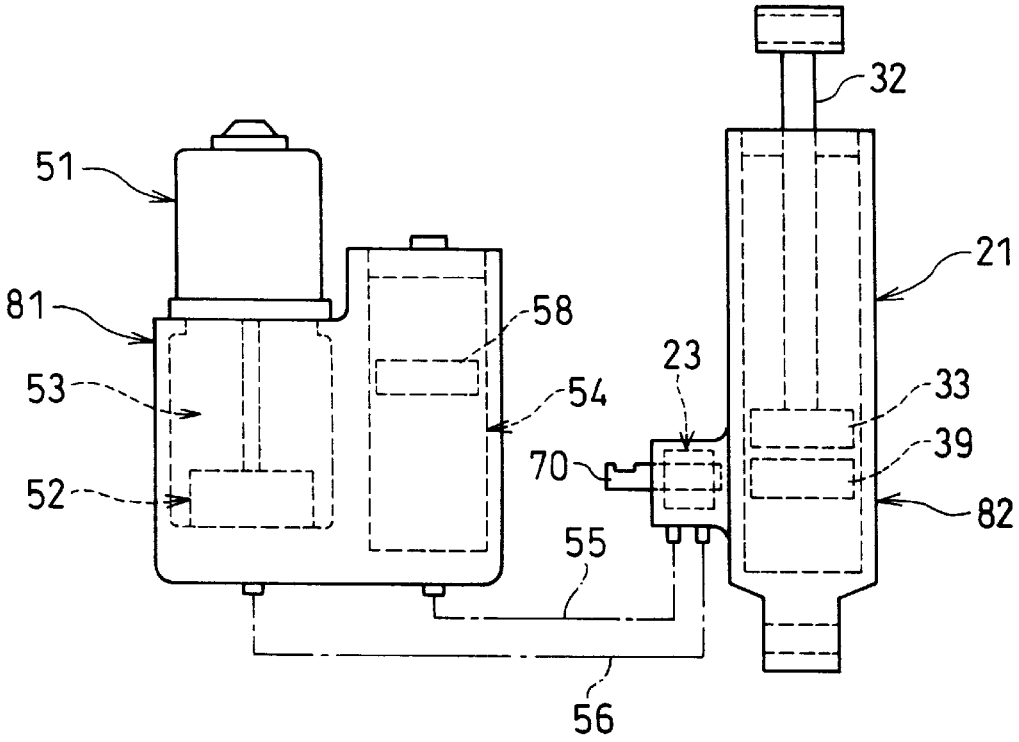
FIG. 3 is an illustrative view showing a first example where the tilting apparatus is configured in a unit.

As shown in FIG. 3, the pump 52, the accumulator 54 and the accumulated pressure sensor 60 are provided integrally with a tank housing 81 made of an aluminum alloy cast or the like, and the cylinder device 21 and the changing-over valve 23 are provided integrally with a cylinder housing 82 made of an aluminum alloy cast or the like. Pipes of the supply line 55 and the return line 56 extend between the tank housing 81 and the cylinder housing 82. The motor 51 is fixed to the tank housing 81.

According to the first example, the entire configuration of the tilting device 20 can be simplified.

EXAMPLE 2

Figure 4:
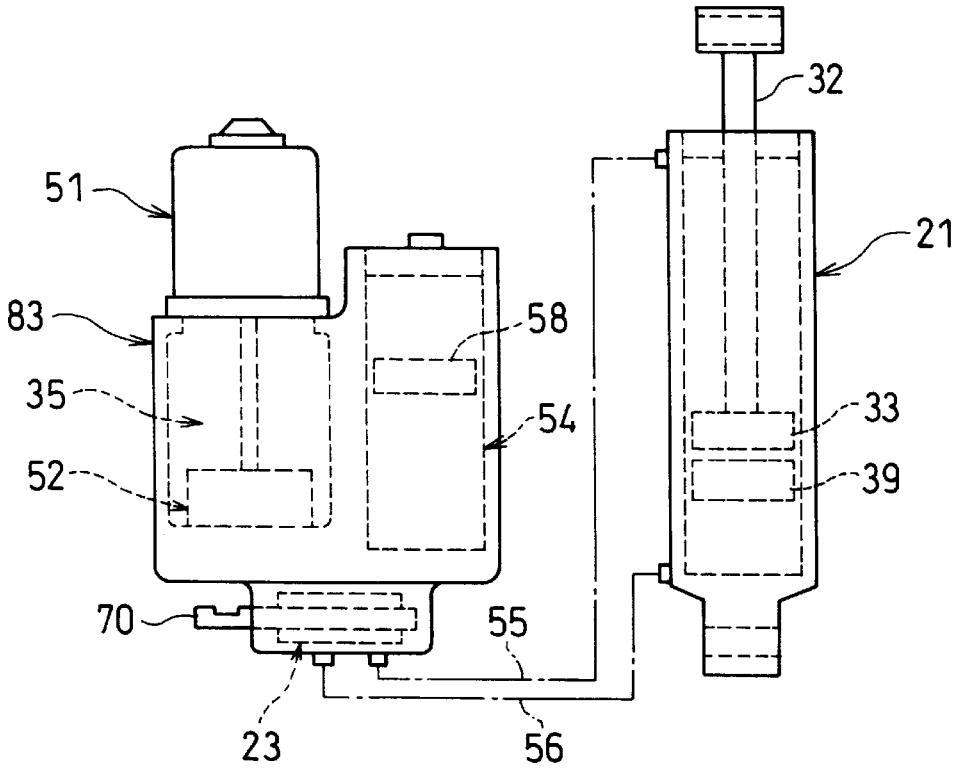
FIG. 4 is an illustrative view showing a second example where the tilting apparatus is configured in a unit.

As shown in FIG. 4, the pump 52, the tank 53, the accumulator 54, the accumulated pressure sensor 60 and the changing-over valve 23 are provided integrally with the tank housing 83 made of an aluminum alloy cast or the like. Pipes of the supply line 55 and the return line 56 extends between the tank housing 83 and the cylinder device 21. The motor 51 is fixed to the tank housing 83.

According to the second example, the entire configuration of the tilting device 20 can be simplified, and changing-over operability can be improved as the changing-over valve 23 is disposed on the side of the pump 52.

EXAMPLE 3

Figure 5:
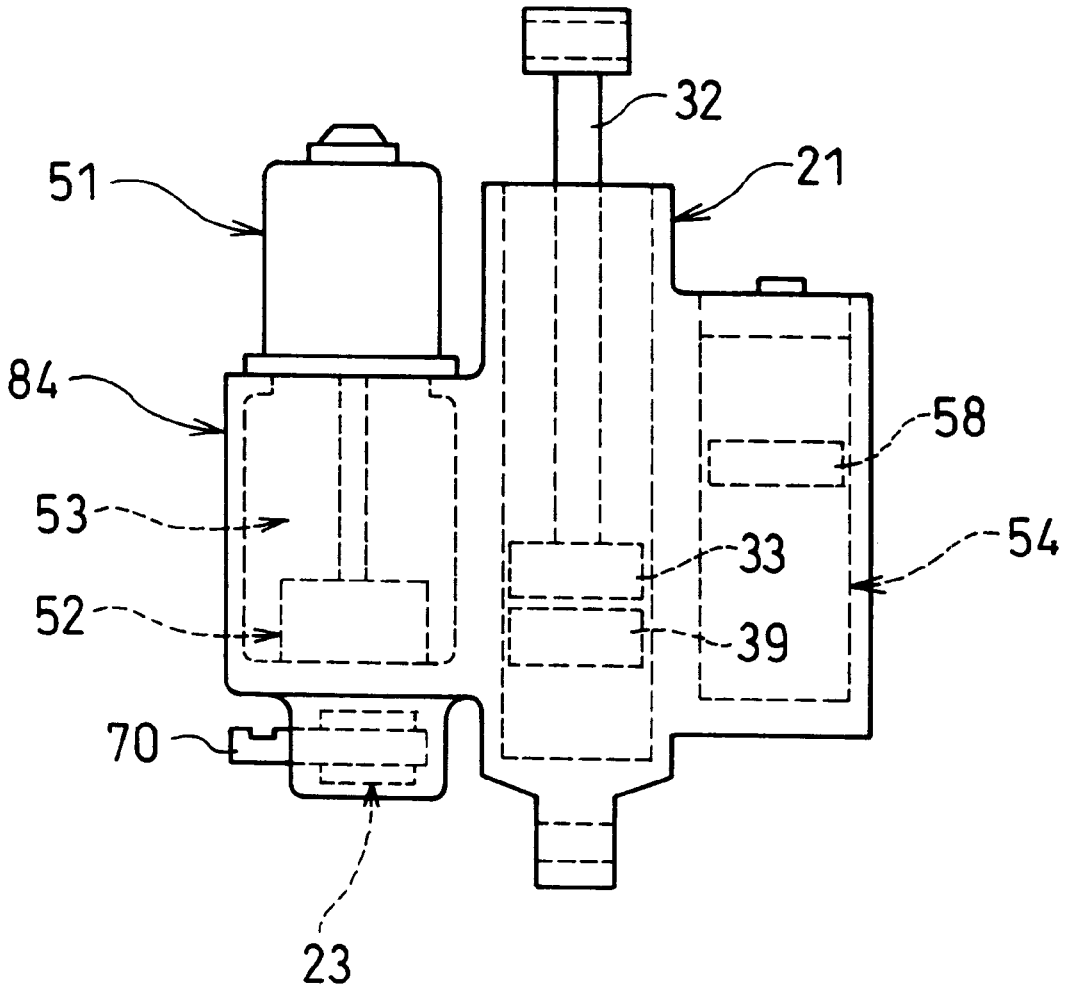
FIG. 5 is an illustrative view showing a third example where the tilting apparatus is configured in a unit.

As shown in FIG. 5, the pump 52, the tank 53, the accumulator 54, the accumulated pressure sensor 60, the changing-over valve 23 and the cylinder device 21 are provided integrally with a single housing 84. The motor 51 is fixed to the housing 54.

According to the third example, the entire configuration of the tilting device 20 can further be simplified and can be reduced in size.

The present invention can employ such a structure that the tank and the pump are provided on the tank housing integrally therewith, and the accumulator, the accumulated pressure sensor, the cylinder device and the changing-over valve are provided on the cylinder housing integrally therewith.

As mentioned above, according to the present invention, the tilt-up operation of a marine propulsion unit can be speeded up independent of the capacity of a pump.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, oniissions and additions may be made to the present invention without departing from the spirit and scope thereof. Therefore, the present invention should not be understood as limited to the specific embodiment set out above, but to include all possible embodiments which can be embodied within a scope encompassed and equivalents thereof with respect to the feature set out in the appended claims.

What is claimed is:

1. A tilting apparatus for a marine propulsion unit which is provided with a cylinder device interposed between a ship body and a marine propulsion unit, a tank for reserving hydraulic oil, a pump for discharging the hydraulic oil in the tank, and a changing-over valve capable of changing over and connecting a supply line for the hydraulic oil discharged by the pump to a chamber positioned opposite to a piston rod of the cylinder device, comprising:

an accumulator provided in a portion of the supply line positioned between the pump and the changing-over valve, for accumulating the hydraulic oil discharged by the pump;

an accumulated pressure sensor for detecting accumulated-pressure in the accumulator; and a control circuit for accumulating the hydraulic oil in the accumulator by driving the pump when the accumulated-pressure in the accumulator detected by the accumulated-pressure sensor becomes lower than a preset value.

2. A tilting apparatus for a marine propulsion unit according to claim 1, wherein a variable flow rate throttle valve is interposed in a return line of the hydraulic oil of the cylinder device.

3. A tilting apparatus for a marine propulsion unit according to claim 1, wherein the tank, the pump, the accumulator and the accumulated pressure sensor are provided integrally with a tank housing, and the cylinder device and the changing-over valve are provided on a cylinder housing integrally therewith.

4. A tilting apparatus for a marine propulsion unit according to claim 2, wherein the tank, the pump, the accumulator and the accumulated pressure sensor are provided integrally with a tank housing, and the cylinder device and the changing-over valve are provided on a cylinder housing integrally therewith.

5. A tilting apparatus for a marine propulsion unit according to claim 1, wherein the tank, the pump, the accumulator, the accumulated pressure sensor and the changing-over valve are provided on a tank housing integrally therewith.

6. A tilting apparatus for a marine propulsion unit according to claim 2, wherein the tank, the pump, the accumulator, the accumulated pressure sensor and the changing-over valve are provided on a tank housing integrally therewith.

7. A tilting apparatus for a marine propulsion unit according to claim 1, wherein the tank, the pump, the accumulator, the accumulated pressure sensor, the cylinder device and the changing-over valve are provided on a single housing integrally therewith.

8. A tilting apparatus for a marine propulsion unit according to claim 2, wherein the tank, the pump, the accumulator, the accumulated pressure sensor, the cylinder device and the changing-over valve are provided on a single housing integrally therewith.

* * * * *